US006353421B1

(12) United States Patent
Lalezari et al.

(10) Patent No.: US 6,353,421 B1
(45) Date of Patent: Mar. 5, 2002

(54) DEPLOYMENT OF AN ELLECTRONICALLY SCANNED REFLECTOR

(75) Inventors: Farzin Lalezari, Boulder; P. Keith Kelly, Lakewood; Robert Marshall, Longmont; Juan Pressas, Aurora, all of CO (US)

(73) Assignee: Ball Aerospace and Technologies Corp., Boulder, CO (US)

( * ) Notice: Subject to any disclaimer, the term of this patent is extended or adjusted under 35 U.S.C. 154(b) by 0 days.

(21) Appl. No.: 09/661,996

(22) Filed: Sep. 14, 2000

(51) Int. Cl.[7] ..... H01Q 15/20; H01Q 1/08
(52) U.S. Cl. ..... 343/915; 343/881; 343/DIG. 2
(58) Field of Search ..... 343/415, DIG. 2, 343/880, 881, 912

(56) References Cited

U.S. PATENT DOCUMENTS

| | | | | | |
|---|---|---|---|---|---|
| 3,264,649 | A | | 8/1966 | White | 343/915 |
| 3,381,923 | A | | 5/1968 | Berry | 248/166 |
| 3,496,687 | A | | 2/1970 | Greenberg et al. | 52/109 |
| 3,503,072 | A | | 3/1970 | Thompson | 343/705 |
| 3,690,080 | A | | 9/1972 | Dillard | 52/108 |
| 4,343,005 | A | | 8/1982 | Han et al. | 343/781 |
| 4,482,900 | A | | 11/1984 | Bilek et al. | 343/915 |
| 4,613,870 | A | | 9/1986 | Stonier | 343/915 |
| 4,725,025 | A | | 2/1988 | Binge et al. | 244/173 |
| 4,769,647 | A | | 9/1988 | Herbig et al. | 343/915 |
| 4,780,726 | A | * | 10/1988 | Archer et al. | 343/915 |
| 4,811,034 | A | | 3/1989 | Kaminskas | 343/915 |
| 4,841,305 | A | | 6/1989 | Rose | 343/912 |
| 4,845,511 | A | * | 7/1989 | Grayson et al. | 343/915 |
| 4,862,190 | A | | 8/1989 | Palmer et al. | 343/915 |
| 4,989,015 | A | | 1/1991 | Chang | 343/915 |
| 5,061,945 | A | | 10/1991 | Hull et al. | 343/840 |
| 5,072,236 | A | | 12/1991 | Chang et al. | 342/351 |
| 5,198,832 | A | * | 3/1993 | Higgins et al. | 343/915 |
| 5,257,034 | A | | 10/1993 | Turner et al. | 343/915 |
| 5,351,062 | A | | 9/1994 | Knapp et al. | 343/880 |
| 5,440,801 | A | | 8/1995 | Marks et al. | 29/600 |
| 5,515,067 | A | | 5/1996 | Rits | 343/912 |
| 5,642,122 | A | | 6/1997 | Lockie et al. | 343/881 |
| 5,771,027 | A | | 6/1998 | Marks et al. | 343/912 |
| 5,857,648 | A | | 1/1999 | Dailey et al. | 244/158 R |
| 5,963,182 | A | * | 10/1999 | Bassily | 343/915 |
| 5,969,695 | A | * | 10/1999 | Bassily et al. | 343/915 |

* cited by examiner

*Primary Examiner*—Don Wong
*Assistant Examiner*—Hoang Nguyen
(74) *Attorney, Agent, or Firm*—Sheridan Ross P.C.

(57) ABSTRACT

A deployable reflector for an electronically scanned reflector antenna is provided. The deployable reflector may be confined to a relatively small volume for transportation of the reflector to a deployment site. Upon deployment, the reflector of the present invention forms a relatively large reflector surface, having a precisely controlled surface geometry. The reflector generally includes a plurality of panel members interconnected to a plurality of ribs interconnected to an extendable boom. The antenna reflector of the present invention is particularly well suited for a space-based antenna, where a reflector that can be collapsed into a small volume for transport and deployed to form a large reflector surface having high gain is desirable.

40 Claims, 12 Drawing Sheets

DEPLOYMENT OF AN ELLECTRONICALLY SCANNED REFLECTOR

FIELD OF THE INVENTION

The present invention relates to radio frequency antennas employing reflectors. In particular, the present invention relates to a deployable reflector for an electronically scanned antenna system.

BACKGROUND OF THE INVENTION

Antennas are used to radiate or receive radio wave signals. The transmission and reception of radio wave signals is useful in a broad range of activities. For instance, radio wave communication systems are desirable where communications are transmitted over large distances.

One type of antenna for use with radio wave communications is the reflector antenna. Reflector antennas typically feature a relatively large reflector surface, to increase the gain of the antenna. The reflector surface may take any one of a number of geometrical configurations, such as plane, corner, and curved configurations An electronically scanned reflector antenna is an antenna that uses a phased array feed to illuminate a nearby reflector unit in order to generate one or more steerable antenna beams. Such antennas are increasingly used in space-based applications such as, for example, satellite communications applications. As can be appreciated, it is difficult to transport large antenna reflectors into space. Therefore, it is desirable to have a deployable reflector that can be collapsed into a relatively small volume for transport, and deployed as a relatively large reflector surface at the antenna site.

It is desirable that a reflector for an antenna be relatively inexpensive to construct. In addition, it is desirable that such a reflector have a precisely controlled surface geometry to ensure the highest possible antenna efficiency. Previously, deployable antennas using fabric-type reflector surfaces have been constructed from single pieces of fabric or several large pieces. Such reflector assemblies are expensive and difficult to manufacture, as it is difficult to control the shape of large pieces of fabric, particularly where the reflector has a curved surface. Other fabric-type reflectors have used relatively small, complex pieces of fabric that are joined to one another, again resulting in a reflector that is difficult and expensive to manufacture. Still other fabric type reflectors use an "umbrella" type deployment mechanism having the shape of a paraboloid, with ribs that are bowed, and therefore shaped, by the fabric of the reflector surface. In addition, previous fabric-type antenna reflector designs have been incapable of providing a large reflector surface having a precisely controlled surface geometry to provide high gain, a small storage volume, and a reliable deployment mechanism in a space-based antenna application.

Therefore, there is a need for a method and apparatus for providing a large reflector surface for space-based antenna applications. In particular, there is a need for a method and apparatus for providing such a reflector that can be stowed in a relatively small volume for transportation to the antenna site, and deployed at the site automatically to provide a reflector surface having high gain. Furthermore, there is a need for a large reflector surface suitable for use in connection with an electronically scanned reflector antenna system. In addition, such a method and apparatus should be relatively easy to manufacture and operate.

SUMMARY OF THE INVENTION

In accordance with the present invention, a deployable antenna reflector for a space-based antenna system is disclosed. The reflector generally includes a plurality of fabric panel members and a connecting assembly interconnected to the panel members, and movable from a stowed state into a deployed state. In a stowed state, the components of the connecting assembly are within a relatively small distance of one another, and the fabric of the plurality of panel members is folded. In a deployed stated, the components of the connecting assembly are moved apart from one another to hold the panel members in tension, thereby forming a reflector surface.

The panel members generally comprise identical panels of fabric or metallized flexible dielectric sheets, each having associated attachment members. The attachment members provide a convenient means for attaching the panel members to the connecting assembly. In addition, the provision of the panel members in one or a small number of sizes facilitates assembly of the reflector, and reduces the cost of the reflector.

The connecting assembly generally includes ribs having contoured front surfaces for shaping the panel members and thus the reflector when the reflector is in a deployed state. The ribs are generally carried by an extendable boom.

When the reflector is in a stowed state, the ribs are in relatively close proximity to one another. According to one embodiment of the present invention, each rib can also be folded about a centrally located hinge, so that the reflector can be placed in a relatively small container for transportation. Upon deployment, the ribs are opened about the centrally located hinges, and the boom is extended, moving the interconnected ribs apart from one another. The extension of the boom additionally tensions the panel members, which are held between adjacent ribs, forming the reflector surface. According to one embodiment of the present invention, adjacent panel members in a row are affixed to the same pair of ribs, but are not directly interconnected to one another.

For use as part of an antenna system that will be located in a remote location such as the polar regions of Earth or in space, the reflector assembly is placed in a first, or folded, condition, and is transported to the antenna site. Once at the antenna site, the reflector assembly is placed in a second, deployed state in which the plurality of panels is held in tension between individual ribs of the connection assembly to form a reflector surface.

The present invention includes a method of forming panel members for use in a deployable antenna reflector. According to this method, a foldable fabric having a surface capable of reflecting electromagnetic radiation is formed into regularly sized panels. The panels are affixed at a first end to a first attachment member, and at a second end to a second attachment member. The panels are next placed under a predetermined amount of tension, and holes are formed through the first and second ends of the panel. The panel is then ready for use in a reflector assembly.

Based on the foregoing summary, a number of salient features of the present invention are readily discerned. An antenna reflector having a large surface area when deployed, but requiring a small volume for transport, can be provided. The antenna reflector provides a high gain, due to its large size and precise surface control. The antenna reflector is well suited for use in space-based applications, as it can be compactly stowed for transportation to the antenna site, and deployed at the site without direct human intervention. The antenna reflector can be formed from a plurality of like-sized panels to increase the accuracy of the reflector surface when deployed, and to decrease manufacturing costs.

Additional advantages of the present invention will become readily apparent from the following discussion, particularly when taken together with the accompanying drawings.

DETAILED DESCRIPTION

In accordance with the present invention, a deployable reflector for an electronically scanned reflector antenna system is provided.

Figure 1:
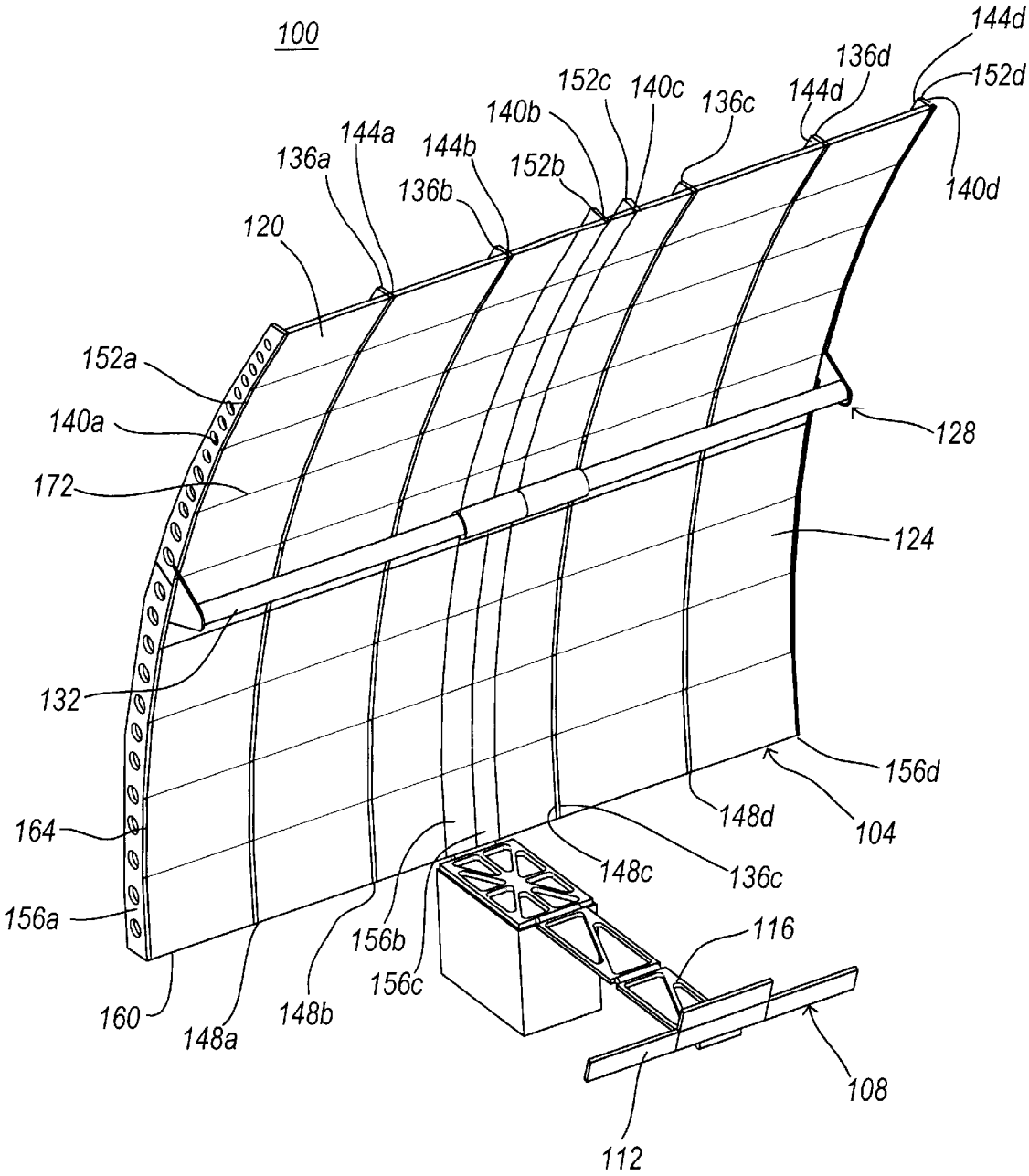
FIG. 1 is a perspective view of an electronically scanned reflector antenna system in accordance with the present invention, with the reflector shown in a deployed condition.

With reference to FIG. 1, an electronically scanned reflector antenna system 100 having a deployable reflector assembly 104 is illustrated. As illustrated in FIG. 1, the antenna system 100 includes, in addition to the reflector assembly 104, a feed assembly 108. The feed assembly 108 includes a feed 112 and a positioning member 116. Generally, the reflector assembly 104 serves to direct radio waves received from a remote source (not shown) to the feed 112 of the feed assembly 108. Additionally, the reflector assembly 104 directs radio waves transmitted from the feed 112 towards a remote source (not shown). Accordingly, the feed 112 is preferably positioned by the positioning member 116 so that it is located at the focal point of the reflector 104. Although the front surface 120 of the reflector assembly 104 illustrated in FIG. 1 describes a parabolic cylinder, reflector assemblies 104 in accordance with the present invention additionally include assemblies 104 having a front surface 120 that is planar, that is circular, that is shaped but cylindrical, or that forms a corner type reflector.

The reflector assembly 104 generally includes a plurality of panel members 124 and a connecting assembly 128. The connecting assembly 128 includes a boom 132, interior ribs 136*a–d,* and end ribs 140*a–d*. Each of the interior ribs 136*a–d* is divided into first 144*a–d* and second 148*a–d* subassemblies. Similarly, each of the end ribs 140*a–d* is divided into first 152*a–d* and second 156*a–d* subassemblies. In the deployed state or condition of the reflector assembly 104 illustrated in FIG. 1, the boom 132 is in an extended position, and the panel members 124 are held in tension between the end ribs 140*a–d*. Where the panel members 124 are of like size, the ribs 136 and 140 are parallel to one another when the reflector assembly is in a deployed condition.

The ribs 136 and 140, together with the panel members 124 cooperate to form the reflector 160 of the reflector assembly 104. The reflector 160, in the embodiment illustrated in FIG. 1, is generally divided into two subassemblies. The first reflector subassembly 164 includes end ribs 140*a* and 140*b,* interior ribs 136*a* and 136*b,* and the panel members 124 affixed to those ribs 136*a–b* and 140*a–b*. The second reflector subassembly 168 of the reflector 160 generally includes end ribs 140*c* and 140*d,* interior ribs 136*c* and 136*d,* and the panel members 124 attached to those ribs 136*c–d* and 140*c–d*. Accordingly, the end ribs 140*a* and 140*b* of the first subassembly 164 of the reflector 160 cooperate to hold the panel members 124 positioned between the end ribs 140*a* and 140*b* in tension, while the interior ribs 136*a* and 136*b* assist in maintaining the desired surface geometry of the reflector 160. Similarly, end ribs 140*c* and 140*d* of the second subassembly 168 of the reflector 160 cooperate to hold the panel members 124 located between the end ribs 140*c* and 140*d* in tension, while the interior ribs 136*c* and 136*d* assist in maintaining the desired geometry of the second subassembly 168 of the reflector 160.

Although the embodiment illustrated in FIG. 1 includes first 164 and second 168 subassemblies, such a configuration is not necessary to the present invention. For example, the reflector 160 could be comprised of one pair of end ribs 140 with any number of interior ribs 136, including no interior ribs 136. Additionally, the reflector 160 can, according to the present invention, be formed from more than two reflector subassemblies 164 and 168. In yet another embodiment of the reflector 160 illustrated in FIG. 1, the first 164 and second 168 reflector subassemblies may share an end rib 140. For instance, end ribs 140*b* and 140*c* may comprise a single end rib 140.

Figure 2:
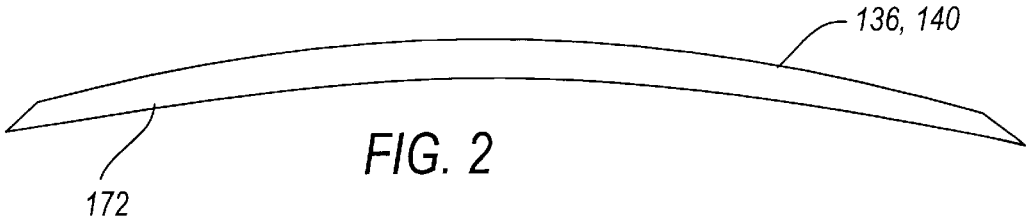
FIG. 2 is a plan view of a rib of a reflector assembly in accordance with the present invention.

In the embodiment illustrated in FIG. 1, a row of like-sized panel members 124 is held between each adjacent pair of ribs 136 and 140. The ribs 136 and 140 are contoured on a front side 172 corresponding to the front surface 120 of the reflector assembly 104. (See FIG. 2). The contoured surface 172 enables the ribs 136 and 140 to impart a curvature or arc to the panel members 124 when the panel members 124 are held in tension between the ribs 136 and 140. This is because the panel members 124 are mounted to the ribs 136 and 140 in such a way that they follow the curve of the front surface 172 of the ribs 136 and 140. The contoured front surface 172 of the ribs 136 and 140 provides the reflector assembly 104 with the curvature required to form a reflector 160 having a generally parabolic, circular or shaped cross section to direct radio waves incident on the reflector 104 to the feed 112. Of course, where the reflector 160 is planar, the front surface 172 of the ribs 136 and 140 will be linear, rather than curved.

In addition, the ribs 136 and 140 may have a front surface 172 comprised of a series of straight segments, so that the ribs 136 and 140 approximate a curve over the entire length of the ribs 136 and 140. Preferably, each panel member 124 is attached to the ribs 136 and 140 such that it abuts, but does not overlap, adjacent panel members 124. According to one embodiment of the present invention, adjacent panel members 124 in a row of panel members 124 are interconnected to the same adjacent ribs 136 and 140, but are not directly interconnected to one another.

Figure 3A:
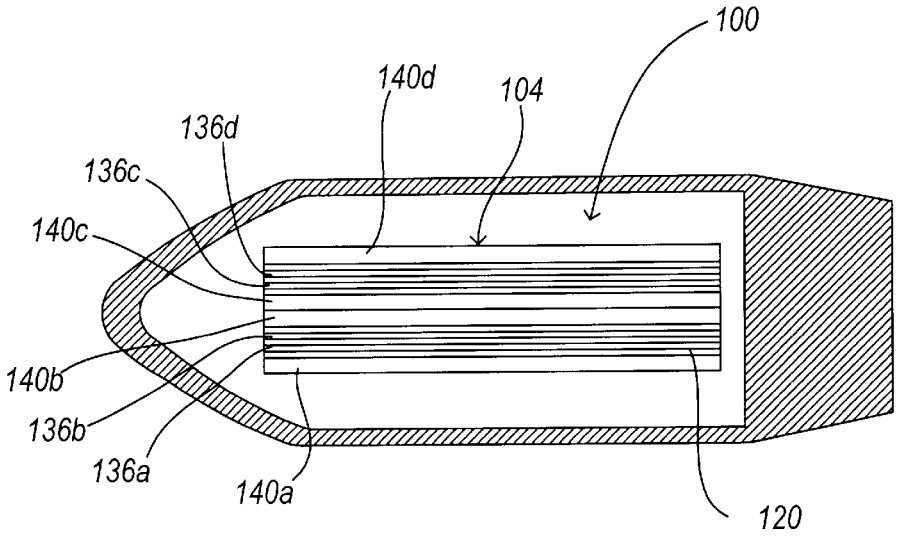
FIG. 3A is a side view of an electronically scanned reflector antenna system in accordance with the present invention with the reflector shown in a collapsed condition in the payload container of a spacecraft.
Figure 3B:
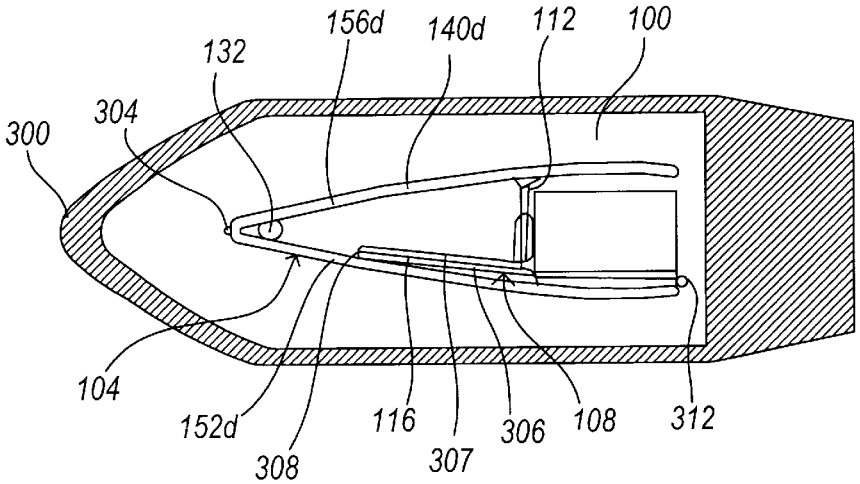
FIG. 3B is a top view of an electronically scanned reflector antenna system in accordance with the present invention with the reflector shown in a collapsed condition in the payload container of a spacecraft.

With reference now to FIGS. 3A and 3B, the antenna system 100, including a reflector assembly 104 according to the present invention, is illustrated in a collapsed condition. In FIG. 3A a side view of the antenna system 100 enclosed within a spacecraft fairing 300 is illustrated, while in FIG. 3B a top view of the antenna system 100 enclosed in a spacecraft fairing 300 is illustrated.

When the reflector assembly 104 is in a collapsed state, the boom 132 of the reflector assembly 104 is also in a collapsed configuration. With the boom 132 in a collapsed configuration, each of the ribs 136 and 140 is at a relatively short distance from its immediately adjacent rib or ribs 136 and/or 140, and the panel members 124 are folded between the ribs 136 and/or 140. Referring now to FIG. 3B, the reflector assembly 104 is shown with the subassemblies or halves 144, 148, 152 and 156 of the ribs 136 and 140 (of which only one end rib 140*d* with corresponding halves 152*d* and 156*d* is visible in FIG. 3B) folded about a rib hinge 304. Each of the ribs 136 and 140 has an associated hinge, which 304 interconnects the halves 144 and 148 or 152 and 156 of the ribs 136 or 140. The use of hinges 304 to interconnect the ribs halves 144 and 148, and 152 and 156 allows the ribs 136 and 140 to be folded as illustrated in FIGS. 3A and 3B, while allowing the ribs 136 and 140 to form a relatively large member when opened about the hinges 304.

The feed assembly 108 is shown in FIG. 3B with the positioning member 116 divided into first 306 and second 307 portions. The positioning member 116 is folded at a positioning member hinge 308, and the feed assembly 108 is further folded at a reflector assembly hinge 312, such that the feed 112 and the feed positioning member 116 are generally located between the folded ribs 136 and 140 of the reflector assembly 104. As illustrated in FIGS. 3A and 3B, the reflector assembly 104, in a collapsed state, can be located within the relatively small confines of a spacecraft fairing 300.

Figure 4:
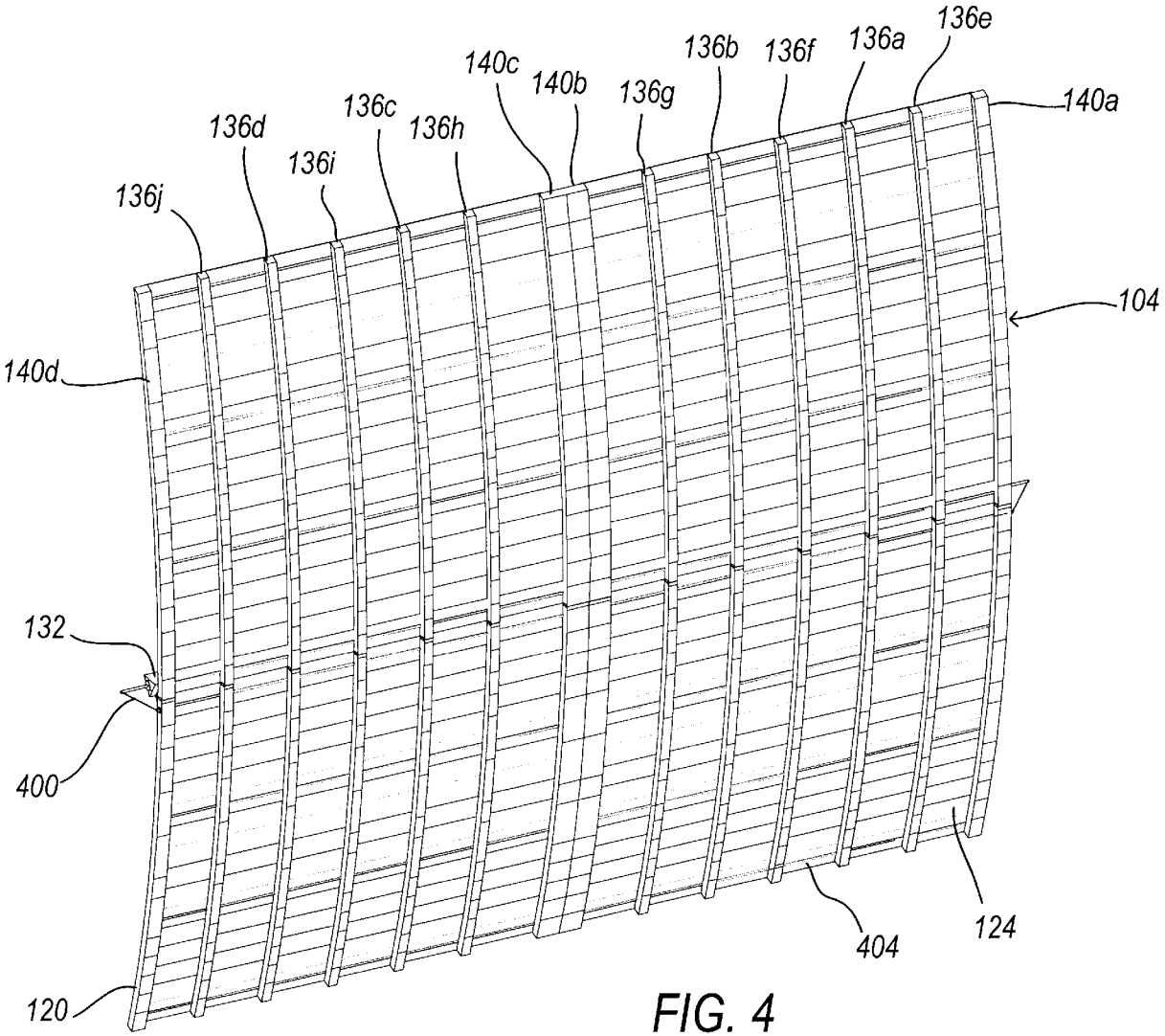
FIG. 4 is a perspective view of the rear of a reflector assembly of an electronically scanned reflector antenna system in accordance with the present invention in a deployed condition.

With reference now to FIG. 4, the reflector assembly 104 is illustrated from a rear perspective view, in a deployed state. This view of the reflector assembly 104 most clearly shows the ribs 136 and 140 that support the panel members 124 when the reflector assembly 104 is in a deployed configuration. The embodiment of the reflector assembly 104 illustrated in FIG. 4 is larger than the reflector assembly 104 illustrated in FIG. 1, and therefore features additional interior ribs 136*e–j* and additional panel members 124. In other respects, the embodiment of the reflector assembly 104 illustrated in FIG. 4 is similar to the embodiment of FIG. 1.

When in the deployed configuration, each of the ribs 136 and 140 are opened about their associated hinges 304 (see FIG. 3B), and the boom 132 is extended. The boom 132 is interconnected to the end ribs 140 by a tensioning assembly 400. According to one embodiment of the invention, the interior ribs 136 are not directly connected to the boom 132. In the deployed configuration, the panel members 124 are held in tension between the ribs 136 and 140.

The end ribs 140 are generally constructed so that they are stronger than the interior ribs 136. Thus, according to one embodiment, such as the one illustrated in FIG. 4, the end ribs 140 may be larger in cross section than the interior ribs 136. The end ribs 140 must be stronger than the interior ribs 136 because the end ribs 140 are required to spread the tensioning force introduced by the tensioning assembly 400 along the length of the rib 140 and to the attached panel members 124. In contrast, the interior ribs 136 are subjected to substantially equal and opposite tensioning forces introduced by the attached opposite rows of panel members 124. Therefore, the interior ribs 136 are not required to have as much strength as the end ribs 132. All of the ribs 136 and 140, however, should be sufficiently stiff so that the desired curvature of the reflector 160 is maintained when the reflector 160 is deployed. Furthermore, all of the ribs 136 and 140 are preferably strong enough that they are not deformed by the force introduced by the tensioning assembly 400 when the reflector assembly 104 is deployed.

According to one embodiment of the present invention, the amount of tension in the panel members 124 is limited by limiting members 404. The limiting members 404 extend between adjacent ribs 136 and 140 and determine the maximum distance between the adjacent ribs 136 and 140, thereby limiting the amount of tension transferred to the panel members 124. According to one embodiment, the limiting members 404 are catenary belts, which are formed from a flexible material so that they can fold with the panel members 124 when the reflector assembly 104 is in a collapsed state. The limiting members 404 are preferably substantially inelastic. In an alternative embodiment, the limiting members 404 may comprise a pantograph formed from stiff pieces of material.

Figure 5:
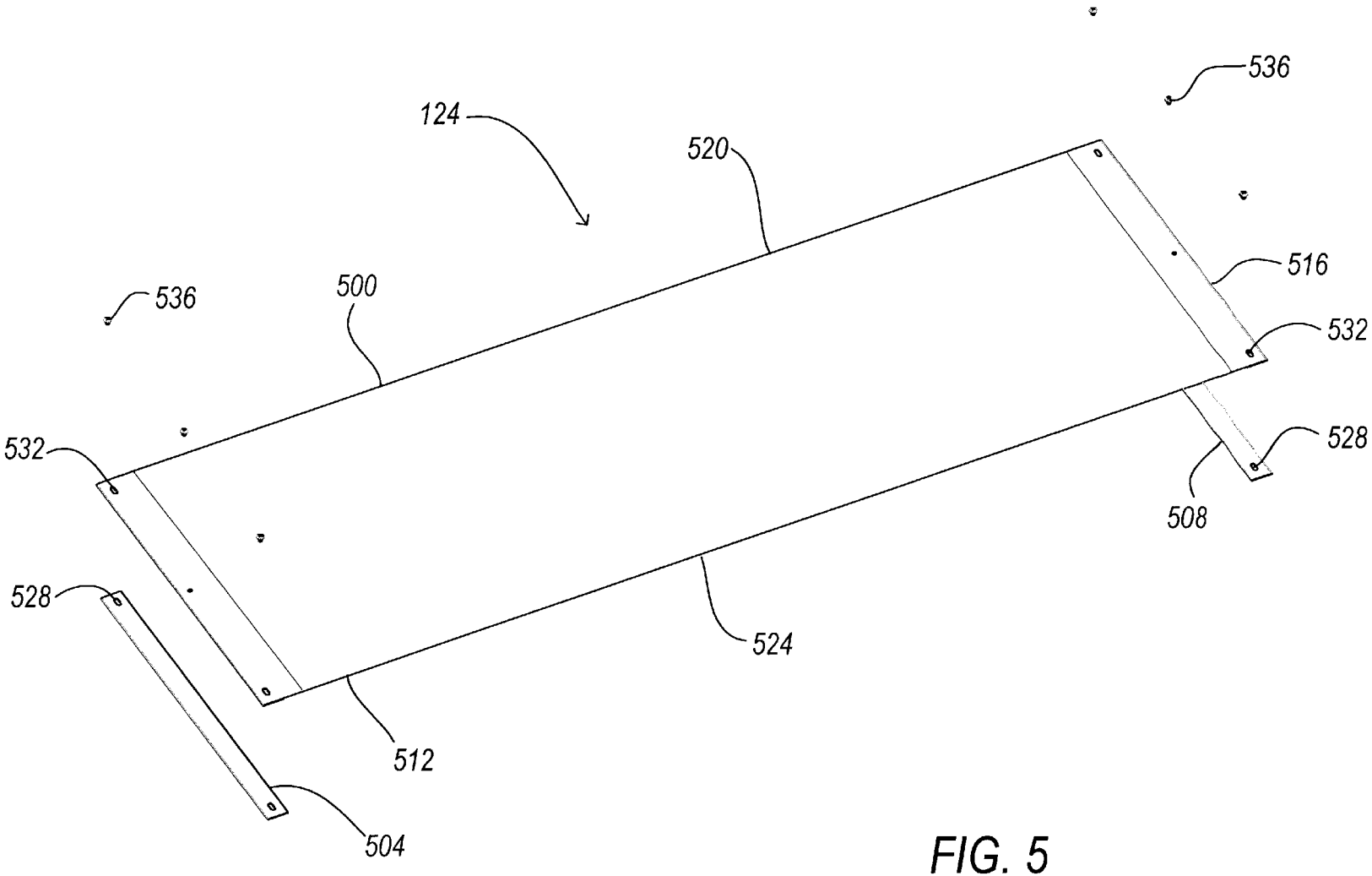
FIG. 5 is an exploded view of a panel member in accordance with the present invention.

With reference now to FIG. 5, each panel member 124 includes a panel 500 and first and second attachment members 504 and 508. Generally, the panels 500 are constructed from a metalicized mesh material that can be folded, and that is capable of reflecting electromagnetic radiation. The panel 500 may be in the shape of a parallelogram, such as the rectangle illustrated in FIG. 5, having a first end 512 and a second end 516, and a first free edge 520 and a second free edge 524. According to one embodiment, each of the panel members 124 of a reflector 160 are the same size. For example, the panel members 124 may be 1.5 m long (along each of the first 520 and second 524 free edges) by 0.5 m wide (along each of the first 512 and second 516 ends). According to the embodiment illustrated in FIG. 5, the attachment members 504 and 508 feature holes 528 that correspond to holes 532 in the panel 500. Fasteners 536 may then be used to extend through the holes 528 and 532 to join the attachment members 504 and 508 to the panels 500. Alternatively or in addition, the attachment members 504 and 508 may be joined to the panels 500 with adhesive.

The attachment members 504 and 508 are generally rectangular in shape, and each attachment member 504 and 508 is designed to support the tension introduced to the individual panel member 124 with which the particular attachment member 504 or 508 is associated without buckling. Where the attachment members 504 and 508 are attached to the front side 172 of the ribs 136 and 140, each attachment member 504 or 508 should be of sufficient length to extend along the end 504 or 508 of the panel member 124 with which the particular attachment member 504 or 508 is associated. This ensures that the panels 500 are evenly supported along their entire width and allows the panel members 124 to follow the curvature of the ribs 136 and 140 over the length of the panel 500. Accordingly, the dimensions of the attachment members 504 depend, at least in part, on the length of the panel member 124 ends 512 and 516 to which a particular attachment member 504 or 508 is associated, on the tension that the attachment member 504 or 508 is intended to support, on the particular method and configuration by which tension is transferred from the ribs 136 and 140 to the panel members 124 and on the material from which the attachment member 504 or 508 is constructed. For example, the attachment members 504 and 508 of a panel member 124 that is affixed to the ribs 136 and 140 using an adhesive could have a smaller thickness and be smaller in a direction parallel to the free edges 520 and 524 of the panel 500 than the attachment members 504 and 508 of like material of a panel member 124 that is affixed to the ribs 136 and 140 using fasteners 536. This is because the tensioning force imparted by the ribs 136 and 140 is relatively evenly distributed along an attachment member 504 or 508 affixed to a rib 136 or 140 using adhesive along the ends 512 and 516 of the panel member 124, while fasteners 536 concentrate the tensioning force at the location of the fasteners 536. Preferably, the attachment members 504 and 508 are formed from a dielectric material, so that the electrical characteristics of the reflector assembly 104 are not altered by the attachment members 504 and 508.

Figure 6:
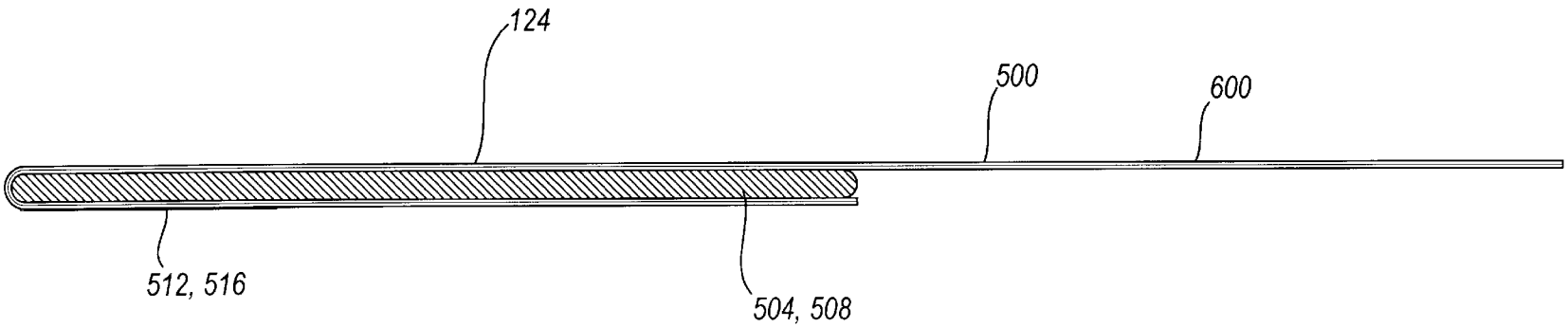
FIG. 6 is a partial side view of a panel member in accordance with the present invention.

FIG. 6 illustrates a partial cross section of an end 512 or 516 of a panel member 124. In particular, FIG. 6 shows the end 512 or 516 of a panel member 500 wrapped around an attachment member 504 or 508. In this way, the attachment member 504 or 508 may evenly distribute the tension applied to the panel 500 across the width of the panel 500. The illustrated configuration also allows the face 600 of the panel 500 (corresponding to the front surface 120 of the reflector assembly 104), to be free from discontinuities.

Figure 7:
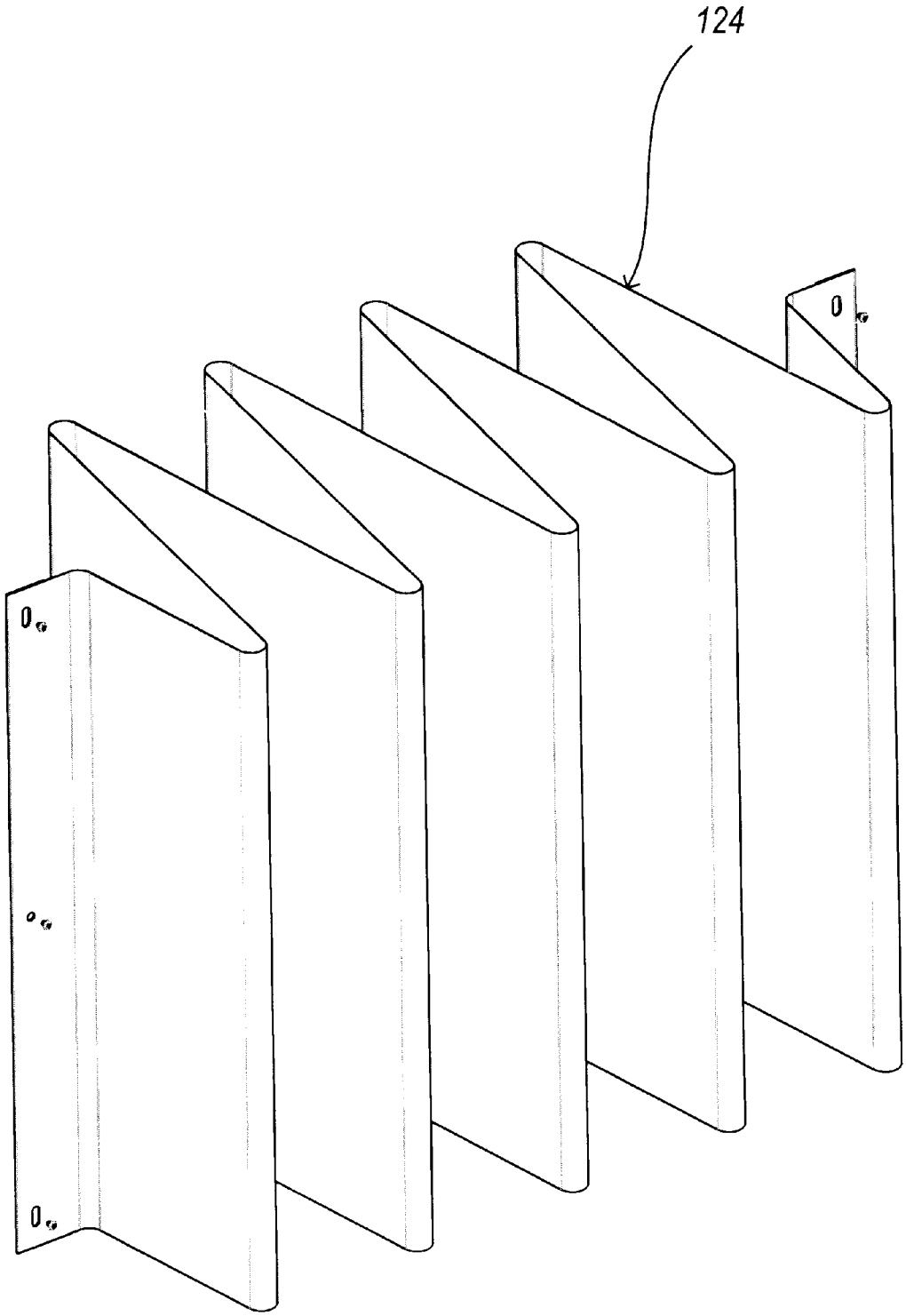
FIG. 7 is a perspective view of a panel member in accordance with the present invention, shown in a partially folded condition.

FIG. 7 illustrates a panel member 124 in a partially folded state. Generally, the panel members 124 of a reflector assembly 104 are completely folded when the reflector assembly 104 is in a collapsed state. As the reflector assembly 104 is deployed, the panel members 120 unfold to form the reflective surface of the reflector 160.

Figure 8:
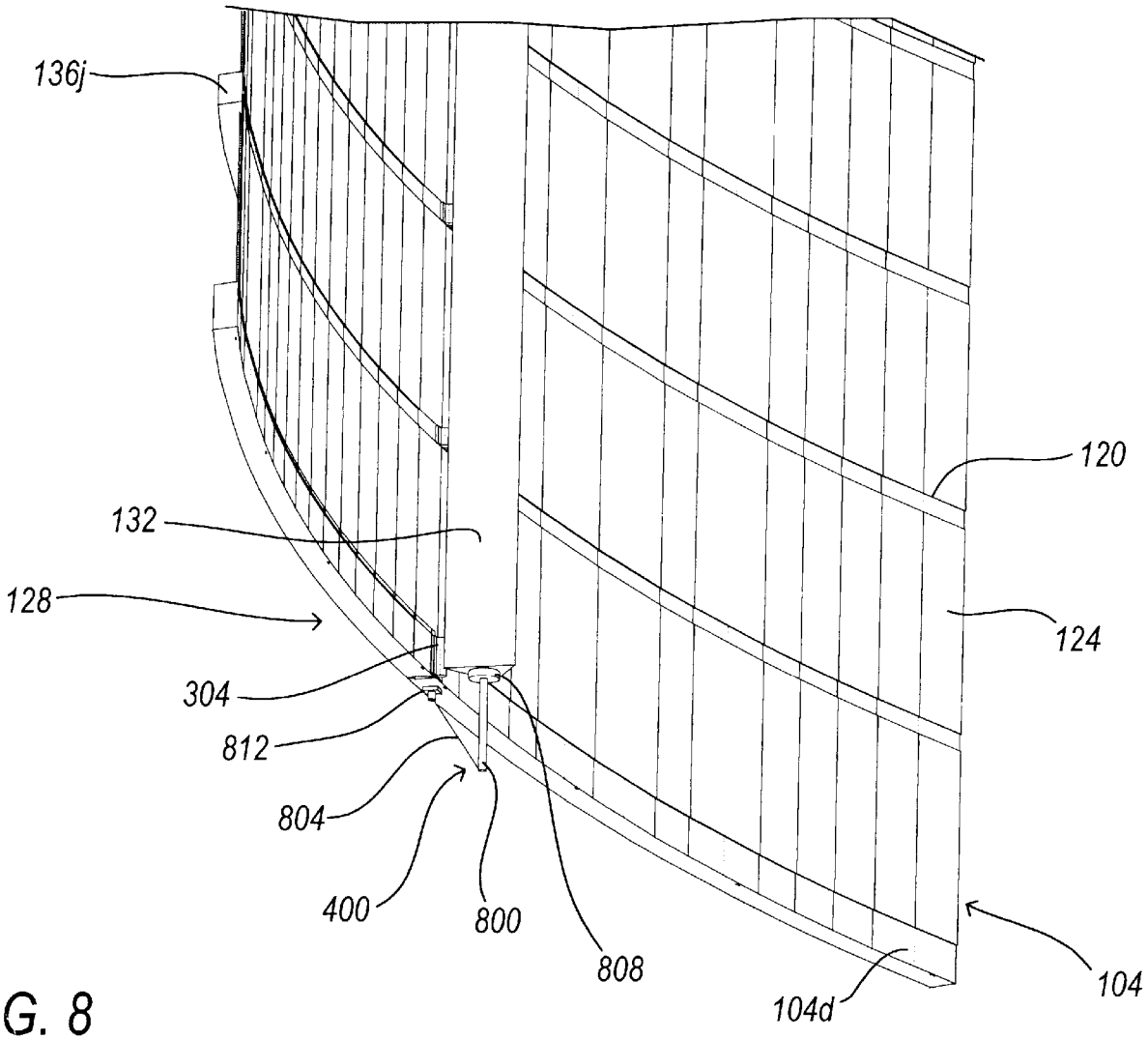
FIG. 8 is a partial perspective view of the front of a reflector assembly in accordance with the present invention.

Referring now to FIG. 8, the reflector assembly 104 is partially illustrated in a front perspective view. In particular, FIG. 8 illustrates the components of the connecting assembly 128, including the tensioning assembly 400. Generally, the tensioning assembly 400 interconnects the end ribs 140 to the boom 132. The tensioning assembly 400 includes a tensioning member 800 and a tensioning linkage 804. The tensioning member 800 is biased outwardly from the boom 132, along an axis of the boom 132, by a spring (not shown) located within a spring housing 808. According to one embodiment, the tensioning member 800 comprises a tensioning rod. The tensioning linkage 804 may comprise a cable fixed to an end rib fitting 812 located on the end rib 140*d* at a first end, and to the end of the tensioning member 800 at a second end. The outward bias of the tensioning member 800 causes the tensioning linkage 804 to pull the end rib 140*d* away from the companion end rib 140*c* (see FIGS. 1 and 4). In this way, the force introduced by the spring to the tensioning member 800 is transmitted to the associated end rib 140 by the tensioning linkage 804. The force is then transmitted from the end rib 140 to the panel members 124, thereby placing the panel members 124 under tension. Ultimately, the tension is carried to the end rib 140*c* (See FIG. 1) that is paired with the end rib 140*d* and that is interconnected to the boom 132. The use of a springloaded tensioning assembly 400 allows the reflector assembly 104 to accommodate manufacturing tolerances that may result in differences between the length of the connecting assembly 128, and the length of the panel members 124 and/or limiting members 404 when the reflector assembly 104 is deployed. Although the use of a spring-loaded tensioning assembly 400 provides certain advantages, it is not required. Additionally, the advantages of a spring-loaded tensioning assembly 400 can be realized even if such an assembly is used at only one end rib 140 in each pair of end ribs 140. For example, in the embodiment illustrated in FIG. 3, end ribs 140*d* and 140*a* may be interconnected to tensioning assemblies 400, while end ribs 140*b* and 140*c* may be rigidly mounted to the boom 132.

Figure 9:
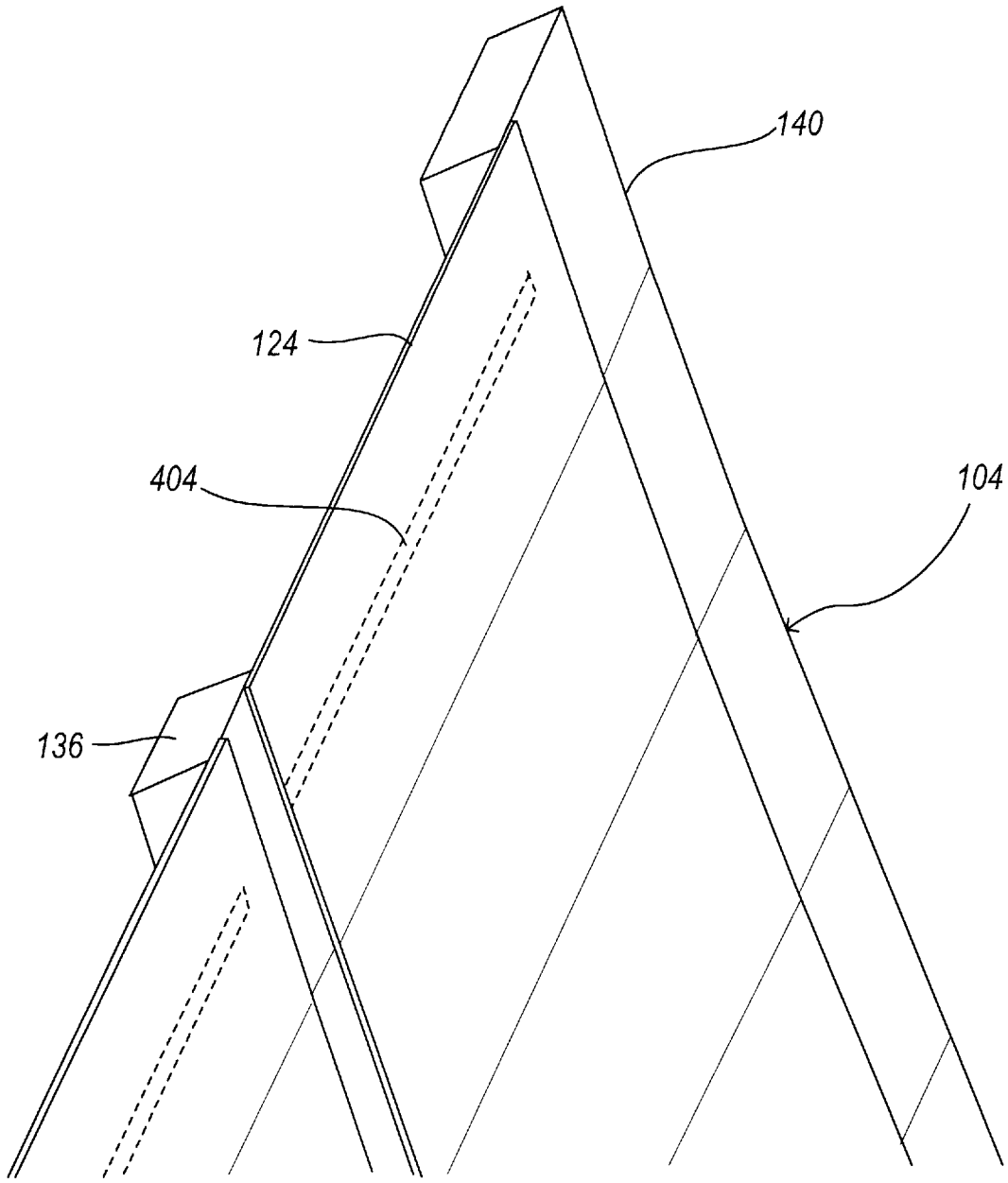
FIG. 9 is another partial perspective view of the front of a reflector assembly in accordance with the present invention.

FIG. 9 illustrates a portion of the reflector assembly 104 while in a deployed state. As shown in FIG. 9, the limiting members 404, shown in FIG. 9 as catenary belts, may be positioned behind the panel members 124, so they do not interfere with the reflective qualities of the reflector 160. As discussed above, the limiting members 404 are affixed to the ribs 136 and 140 to limit the distance between adjacent ribs 136 and 140 when the reflector assembly 104 is deployed. As illustrated in FIGS. 4 and 9, the limiting members 404 may be aligned such that they are substantially parallel to the major axis of the boom 132 when they are in tension. Alternatively or in addition, the limiting members 404 may be affixed to ribs 136 and 140 such that they are at an angle to the boom 132 to provide additional stability to the reflector assembly 104. For instance, the limiting members 404 may be arranged so that they form crossed pairs when the reflector assembly 104 is in a deployed state. By limiting the maximum distance between adjacent ribs 136 and 140, the limiting members 404 may be used to control the tension introduced to the panel members 124. Because the limiting members 404 are preferably inelastic, they also serve to control the position of the inner ribs 136 with respect to each other and to the end ribs 140.

Figure 10:
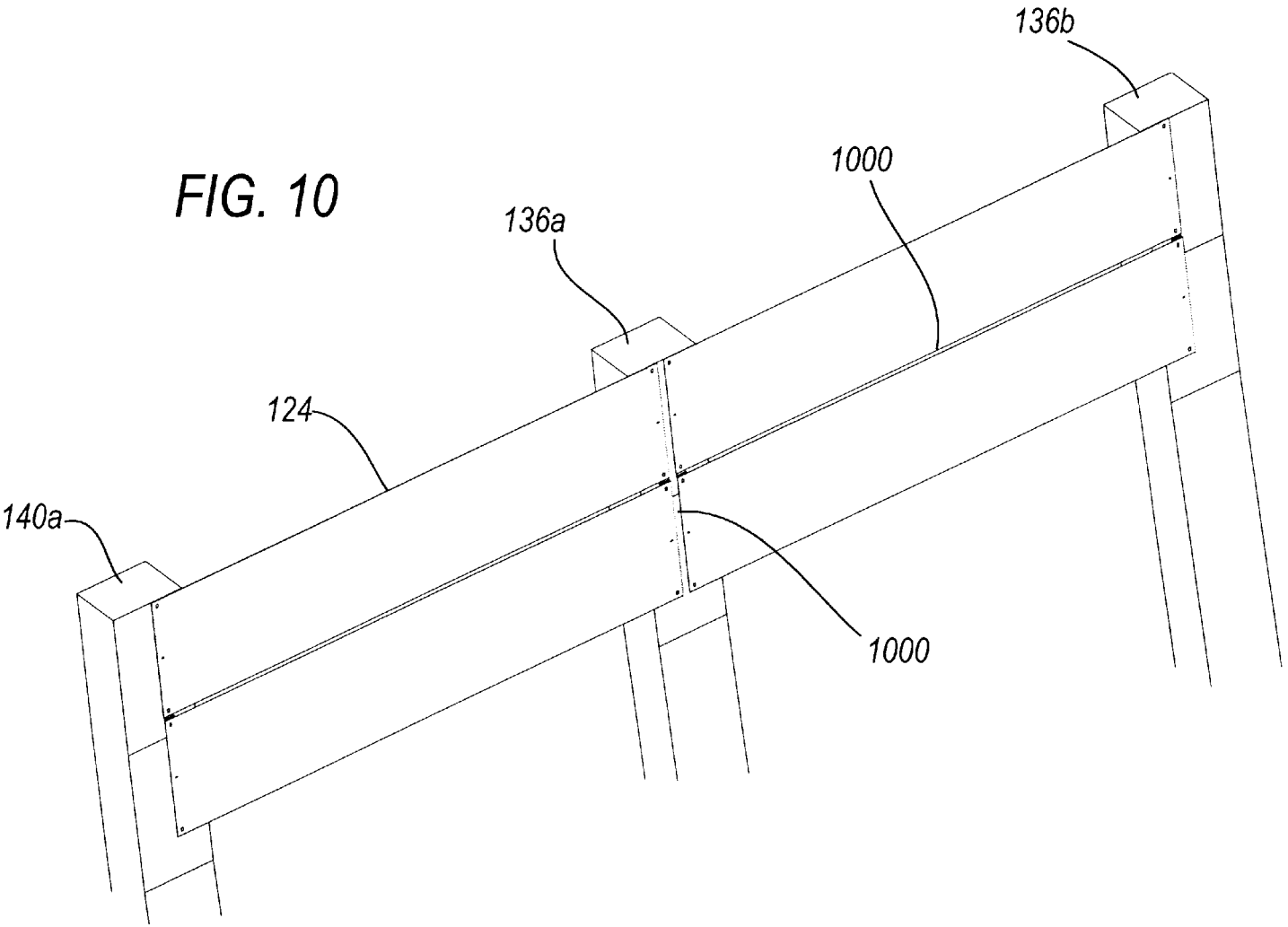
FIG. 10 is yet another perspective view of the front of a reflector assembly in accordance with the present invention.

With reference now to FIG. 10, the connection between the ribs 136 and 140 and the panel members 124 is illustrated. The panel members 124 may be affixed to the ribs 136 and 140 using threaded fasteners 536 or other mechanical fastening means. Alternatively, the panel members 124 may be affixed to the ribs 136 and 140 using an adhesive. The panel members 124 are aligned such that the gaps 1000 between adjacent panel members 124 are very small. By maintaining small gaps 1000 between the panel members 124, the efficiency of the reflector 160 may be optimized. It is preferable that the panel members 124 do not overlap, as any overlap would cause discontinuities in the front surface 120 of the reflector 160, degrading the reflector's 160 efficiency. Preferably, the total area of the gaps 1000 between the panel members 124 is about one percent or less of the total surface area of the reflector 160.

Figure 11:
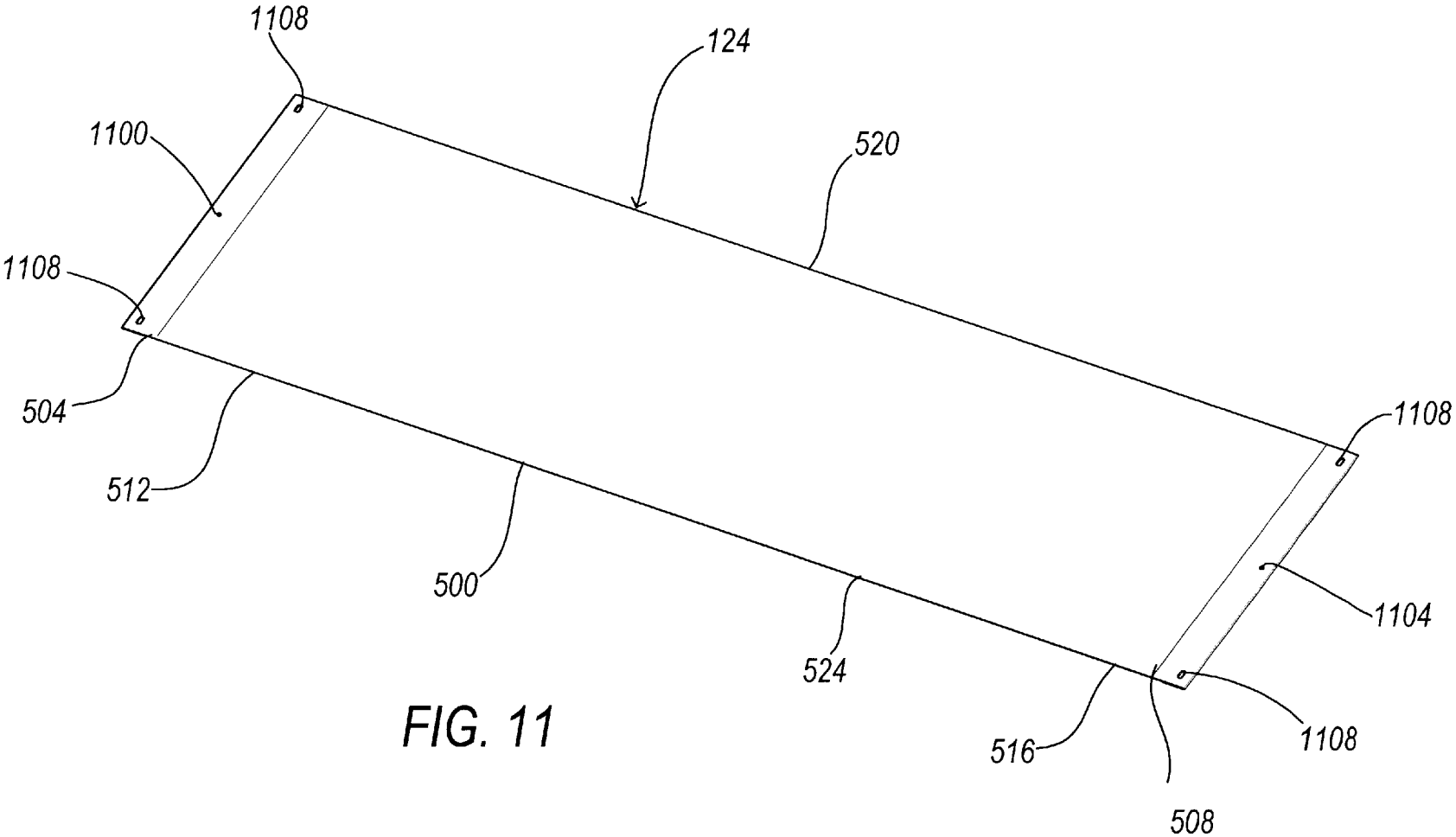
FIG. 11 is a perspective view of a panel member in accordance with the present invention.

With reference now to FIG. 11, a method of forming a panel member 124 will be described. Initially, a panel 500 is cut to the desired width plus any additional material needed to form a hem along the free edges 520 and 524 of the panel 500, if desired. The panel 500 is also cut to the desired length, plus any material needed to wrap about the attachment members 504 and 508, and to form a hem at the ends 512 and 516 of the panel 500, if desired. The ends 512 and 516 of the panel 500 may then be wrapped about the attachment members 504 and 508, and affixed thereto with adhesive. Next, a first center hole 1100 is punched through the center of the panel 500 and the attachment member 504 at the first end 512 of the panel 500. The panel 500 is then placed under a predetermined amount of tension. Generally, the amount of tension is equal to the amount of tension that the panel member 124 will be under when the complete reflector assembly 104 is deployed. While the panel 500 is held under the predetermined amount of tension, a second center hole 1104 is punched in the center of the panel 500 and through the center of the attachment member 508 at the second fixed end of the panel 500, and at a predetermined distance from the first center hole 1000. Finally, holes 1108 are punched in each of the four corners of the panel member 124. The panel member 124 thus formed will have a predetermined length when the panel member 124 is placed under a predetermined amount of tension. Accordingly, the dimensions and characteristics of the deployed reflector 160 can be precisely controlled.

Figure 12B:
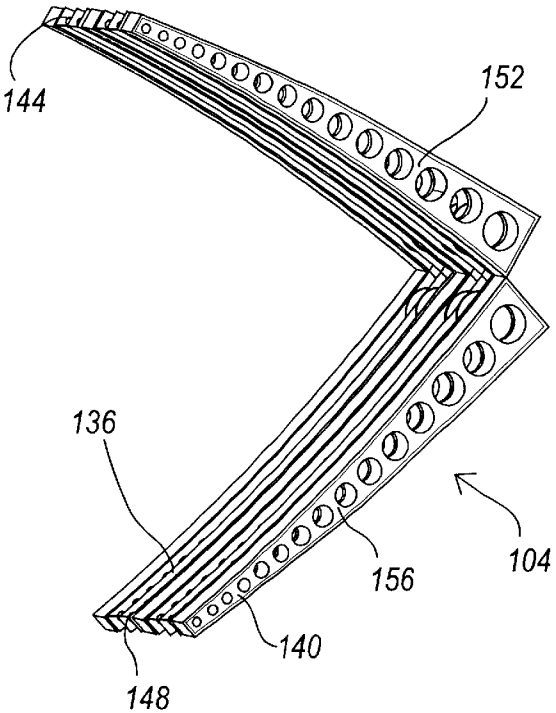
FIGS. 12A–E illustrate the deployment of a reflector assembly in accordance with the present invention from a collapsed condition to a deployed condition.
Figure 12A:
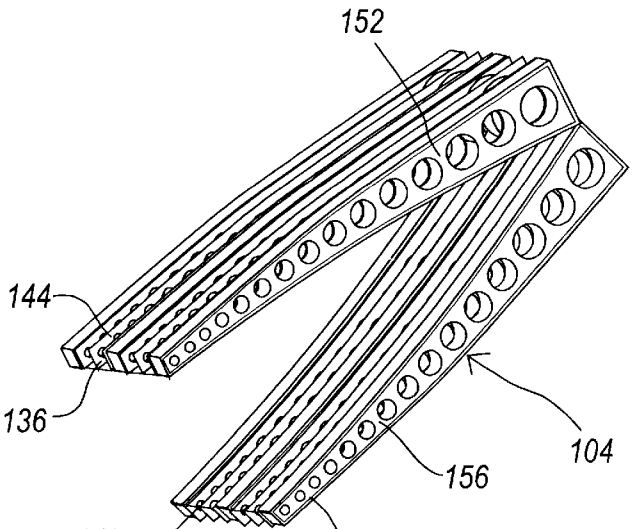
Figure 12C:
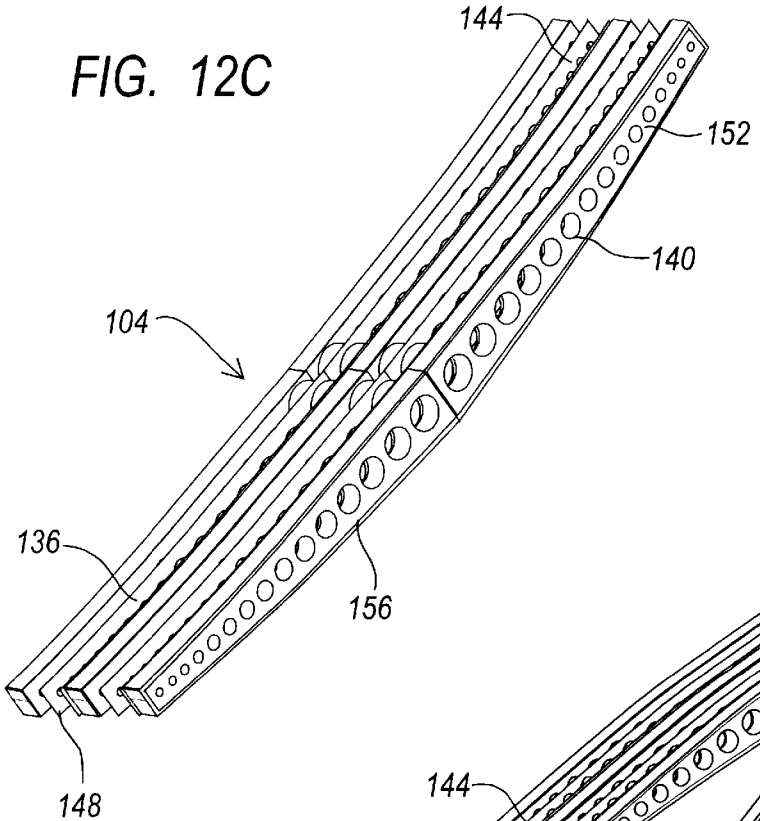

With reference again to FIGS. 3A and 3B, the antenna system 100, including the reflector assembly 104, may be placed in a collapsed condition, allowing the antenna system 100 to be stowed inside a relatively small volume, such as a spacecraft fairing 300. With reference now to FIGS. 12A–E, the deployment sequence of the reflector assembly 104 will be explained. Generally, the reflector assembly 104 is initially transported to the site at which the antenna system is to be deployed. For example, the reflector assembly 104 may be transported into orbit about the Earth in the fairing 300 of a spacecraft. Upon reaching the desired location, the reflector assembly 104 may be removed from the fairing 300. Next, the ribs 136 and 140 of the reflector assembly 104 may be opened about the hinges 304, as is illustrated in FIGS. 12A and 12B. The ribs 136 and 140 are opened until they are fully extended, as illustrated in FIG. 12C. When fully extended, the halves 144, 148, 152 and 156 of the ribs 136 and 140 generally form a continuous front surface or face 172 for supporting the panel members 124 in the desired geometric configuration.

Next, the boom 132 may be extended along its major axis to, through the tensioning assembly 800, draw the end ribs 140 away from each other. When the boom 132 is fully extended, as illustrated in FIG. 12E, the reflector 160 of the reflector assembly 104 will have been fully deployed, and will have reached its final geometric configuration.

Figure 12E:
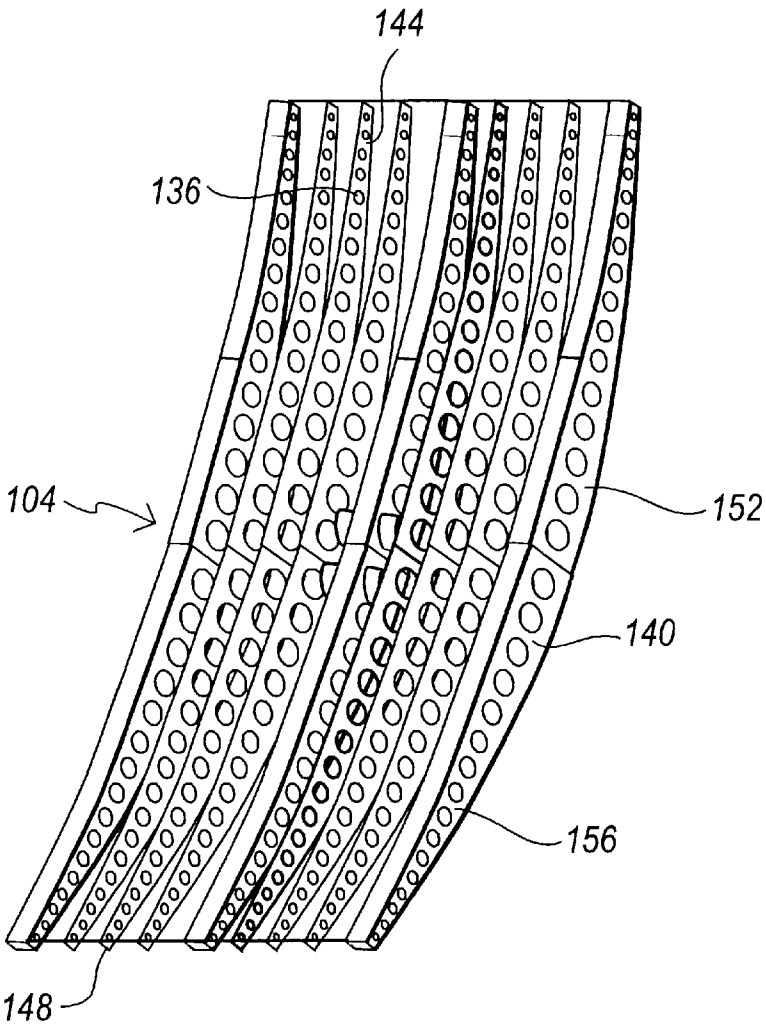
Figure 12D:
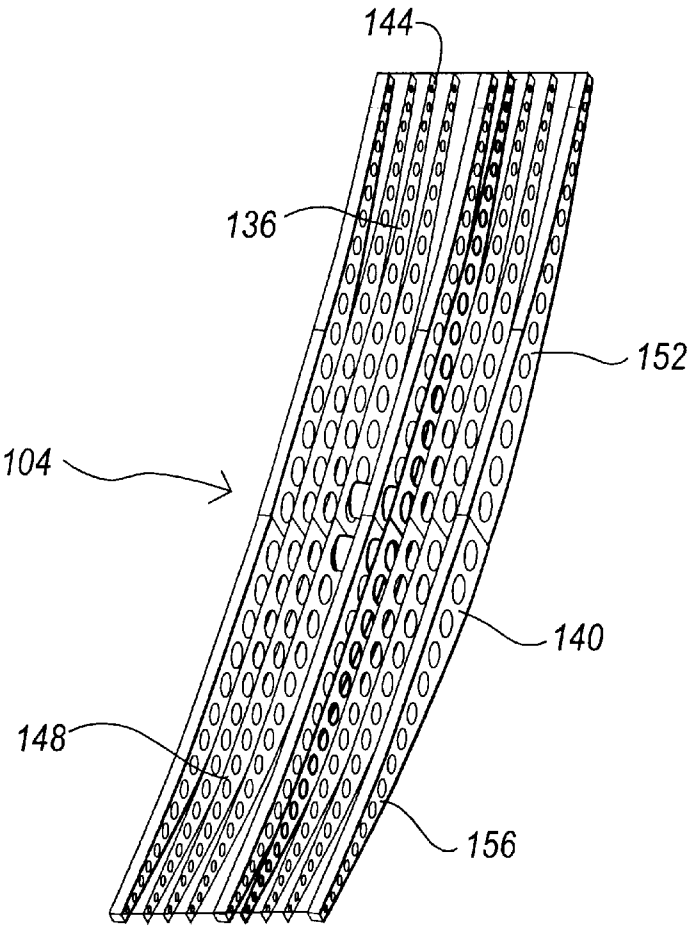

For purposes of illustration, FIGS. 12A–E omit the limiting members 404 and the feed assembly 108, and FIGS. 12D and 12E show the panel members 124 as a continuous surface. Generally, the panels 500 of the panel members 124 are in a folded condition when the reflector assembly 104 is folded as illustrated in FIGS. 3A, 3B and 12A–C. Likewise, the limiting members 404 are also folded when the reflector assembly 104 is in a collapsed state. When the reflector assembly 104 is fully deployed, as illustrated in FIGS. 1, 4 and 12E, the tensioning assembly 800 exerts a force on each associated end rib 140 which pulls those end ribs away from the end rib 140 with which they are paired. The distance between adjacent ribs 136 and 140 is limited by the limiting members 404. Accordingly, the panel members 124 are held under a predetermined amount of tension between the ribs 136 and 140 to which the panel members 124 are affixed. As the panel members 124 do not overlap, and as the gaps 1000 between adjacent panel members 124 are small, a highly efficient reflector 160 is formed when the reflector assembly 104 is deployed.

In accordance with the present invention, a deployable reflector for an electronically scanned reflector antenna is provided. The invention in its broader aspects relates to a reflector antenna system that can be placed in a very small volume for transportation to a deployment site, and that forms a relatively large reflector surface upon deployment. The deployable reflector of the present invention is suitable for use with any antenna requiring a large reflector. The reflector of the present invention can be assembled at relatively low cost to provide a highly accurate reflector surface.

The foregoing discussion of the invention has been presented for purposes of illustration and description. Further, the description is not intended to limit the invention to the form disclosed herein. Consequently, variations and modification commensurate with the above teachings, within the skill and knowledge of the relevant art, are within the scope of the present invention. The embodiments described hereinabove are further intended to explain the best mode presently known of practicing the invention, and to enable others skilled in the art to utilize the invention in such or in other embodiment and with various modifications required by their particular application or use of the invention. It is intended that the appended claims be construed to include alternative embodiments to the extent permitted by the prior art.

What is claimed is:

1. A deployable antenna reflector apparatus, comprising:

a plurality of panel members, wherein said plurality of panel members constitutes substantially all of said panel members of said apparatus, and in which at least a majority of said panel members are substantially of equal size; and a connecting assembly comprising a plurality of ribs interconnected to said plurality of panel members and linearly movable between a first state and a second state, wherein said plurality of ribs are of substantially equal length, wherein for each of said panel members two of said ribs are connected thereto, wherein in said second state each of said ribs connected to said at least a majority of said panel members are substantially parallel to one another, wherein when said connecting assembly is in said first state said plurality of panel members is in a folded condition, and wherein when said connecting assembly is in said second state said plurality of panel members is held in tension to form a reflector surface.

2. The apparatus of claim 1, wherein at least a first surface of each of said plurality of ribs describes an arc, and wherein at least said first surface of each of said ribs is in contact with a portion of at least a one of said panel members.

3. The apparatus of claim 2, wherein said first rib is a first distance from said second rib when said connecting assembly is in said first state, wherein said first rib is a second distance from said second rib when said connecting assembly is in said second state, and wherein said first distance is less than said second distance.

4. The apparatus of claim 1, wherein each of said plurality of panel members comprises:

a panel having a first end, wherein said panel is capable of reflecting electromagnetic radiation when said connecting assembly is in said second state; and at least a first attachment member affixed to said first end of said panel.

5. The apparatus of claim 4, wherein each of said plurality of panel members further comprises a second attachment member, wherein said panel has a second end, and wherein said second attachment member is affixed to said second end of said panel.

6. The apparatus of claim 5, wherein said first and second ends of said panel members are wrapped about at least a first surface of said first and second attachment members.

7. The apparatus of claim 5, wherein said first and second ends of said panel members are affixed to said first and second attachment members with an adhesive.

8. The apparatus of claim 1, wherein a total area of gaps between said panel members is less than about one percent of a total area of said panel members.

9. A deployable antenna reflector apparatus, comprising:

a plurality of panel members; and a connecting assembly interconnected to said plurality of panel members and movable between a first state and a second state, wherein when said connecting assembly is in said first state said plurality of panel members is in a folded condition, and wherein when said connecting assembly is in said second state said plurality of panel members is held in tension to form a reflector surface, wherein said connecting assembly comprises at least first and second ribs with each of said first and second ribs having at least a first surface that describes an arc, and wherein at least said first surface of each of said ribs is in contact with a portion of at least a one of said panel members, wherein said first rib is a first distance from said second rib when said connecting assembly is in said first state, wherein said first rib is a second distance from said second rib when said connecting assembly is in said second state, wherein said first distance is less than said second distance, and wherein said second distance is limited by a limiting member.

10. The apparatus of claim 9, wherein said limiting member comprises a catenary belt.

11. A deployable antenna reflector apparatus, comprising:

a plurality of panel members; and a connecting assembly interconnected to said plurality of panel members and movable between a first state and a second state, wherein when said connecting assembly is in said first state said plurality of panel members is in a folded condition, and wherein when said connecting assembly is in said second state said plurality of panel members is held in tension to form a reflector surface, wherein said connecting assembly comprises at least first and second ribs with each of said first and second ribs having at least a first surface-that describes an arc, and wherein at least said first surface of each of said ribs is in contact with a portion of at least a one of said panel members, and wherein said connecting assembly further comprises a third rib, wherein said first and second ribs are end ribs, and wherein said third rib is an interior rib.

12. A deployable antenna reflector apparatus, comprising:

a plurality of panel members; and a connecting assembly interconnected to said plurality of panel members and movable between a first state and a second state, wherein when said connecting assembly is in said first state said plurality of panel members is in a folded condition, and wherein when said connecting assembly is in said second state said plurality of panel members is held in tension to form a reflector surface, wherein said connecting assembly comprises at least first and second ribs with each of said first and second ribs having at least a first surface that describes an arc, and wherein at least said first surface of each of said ribs is in contact with a portion of at least a one of said panel members, and wherein said connecting assembly further comprises a boom, and wherein at least said first rib is interconnected to said boom by a tensioning assembly.

13. The apparatus of claim 12, wherein said tensioning assembly comprises a spring, wherein said spring biases said first rib in a direction away from said second rib.

14. The apparatus of claim 13, wherein said tensioning assembly further comprises a tensioning member and a tensioning linkage having a first end and a second end, wherein said spring biases said tensioning member outwardly from said boom along an axis of said boom, and wherein said tensioning linkage is interconnected to said first rib at said first end and to said tensioning member at said second end such that said first rib is biased in a direction away from said second rib.

15. The apparatus of claim 14, wherein said tensioning member comprises a tensioning rod and wherein said tensioning linkage comprises a tensioning cable.

16. A deployable antenna reflector apparatus, comprising:

a plurality of panel members; and a connecting assembly interconnected to said plurality of panel members and movable between a first state and a second state, wherein when said connecting assembly is in said first state said plurality of panel members is in a folded condition, and wherein when said connecting assembly is in said second state said plurality of panel members is held in tension to form a reflector surface, wherein said connecting assembly comprises at least first and second ribs with each of said first and second ribs having at least a first surface that describes an arc, and wherein at least said first surface of each of said ribs is in contact with a portion of at least a one of said panel members, and wherein said connecting assembly further comprises a plurality of hinges, and wherein each of said ribs comprise first and second subassemblies interconnected by a one of said hinges.

17. The apparatus of claim 16, wherein when said connecting assembly is in said first state said first and second subassemblies of said ribs are folded about said hinges.

18. The apparatus of claim 17, further comprising a feed assembly, wherein said feed assembly comprises a positioning member having first and second portions, a positioning member hinge interconnecting said first and second portions of said positioning member, a feed interconnected to said positioning member, and a feed assembly hinge interconnecting said positioning member and said connecting assembly, wherein when said connection assembly is in said first state, said feed assembly is positioned between said first and second subassemblies of at least a one of said ribs.

19. The apparatus of claim 16, wherein when said connecting assembly is in said second state said first and second subassemblies of said ribs are opened about said hinges, wherein said ribs form a continuous arc.

20. A method for providing an antenna reflector, comprising:

providing a plurality of flexible panel members, wherein each of said panel members are of like size;

providing a connection assembly, wherein said connection assembly comprises at least first and second like-sized ribs;

affixing said plurality of panel members to said connection assembly to produce a reflector assembly;

placing said reflector assembly in a first state, wherein in said first state said plurality of panels is in a folded condition, and wherein said at least first and second ribs are substantially parallel to one another; and placing said reflector assembly in a second state, wherein in said second state said plurality of panels is held in tension to form a substantially cylindrical reflector surface, and wherein said at least first and second ribs are substantially parallel to one another.

21. The method of claim 20, wherein said step of placing said reflector assembly in a second state comprises tensioning said plurality of panels with a spring.

22. The method of claim 20, wherein said connection assembly comprises a boom that is collapsed when said reflector assembly is in said first state, and wherein said step of placing said reflector assembly in a second state comprises extending said boom.

23. The method of claim 20, wherein said first rib is a first distance from said second rib when said connecting assembly is in said first state, wherein said first rib is a second distance from said second rib when said connecting assembly is in said second state, and wherein said first distance is less than said second distance.

24. The method of claim 23, wherein each of said first and second ribs has a first surface, and wherein at least said first surface of each of said ribs is in contact with at least a one of said panel members at least when said connecting assembly is in said second state.

25. The method of claim 23, wherein said step of placing said reflector assembly in a second state further comprises biasing said first rib away from said second rib.

26. The method of claim 20, further comprising:

transporting said reflector assembly to a deployment site before said step of placing said reflector assembly in a second state.

27. A method for providing an antenna reflector, comprising:

providing a plurality of flexible panel members;

providing a connection assembly;

affixing said plurality of panel members to said connection assembly to produce a reflector assembly;

placing said reflector assembly in a first state, wherein in said first state said plurality of panels is in a folded condition;

placing said reflector assembly in a second state, wherein in said second state said plurality of panels is held in tension to form a reflector surface;

wherein said connection assembly comprises at least first and second ribs, wherein said first rib is a first distance from said second rib when said connecting assembly is in said first state, wherein said first rib is a second distance from said second rib when said connecting assembly is in said second state, wherein said first distance is less than said second distance, wherein each of said first and second ribs has a first surface, wherein at least said first surface of each of said ribs is in contact with at least a one of said panel members at least when said connecting assembly is in said second state, and wherein said first and second ribs each comprise first and second subassemblies interconnected by a hinge, wherein when said connecting assembly is in said first state said first and second subassemblies are folded about said hinges, and wherein said step of placing said reflector assembly in a second state comprises unfolding said first and second ribs about said hinges such that said first surface of each of said ribs forms a continuous arc.

28. A method for providing an antenna reflector, comprising:

providing a plurality of flexible panel members;

providing a connection assembly;

affixing said plurality of panel members to said connection assembly to produce a reflector assembly;

placing said reflector assembly in a first state, wherein in said first state said plurality of panels is in a folded condition;

placing said reflector assembly in a second state, wherein in said second state said plurality of panels is held in tension to form a reflector surface;

wherein said connection assembly comprises at least first and second ribs, wherein said first rib is a first distance from said second rib when said connecting assembly is in said first state, wherein said first rib is a second distance from said second rib when said connecting assembly is in said second state, wherein said first distance is less than said second distance, further comprising providing limiting members to set a maximum distance between said first and second ribs when said reflector assembly is in said second state.

29. A method for producing a panel member for use in a deployable antenna reflector, comprising:

providing a piece of foldable fabric having a surface that is capable of reflecting electromagnetic radiation;

forming a panel having a first end and a second end from said piece of fabric;

providing first and second attachment members;

affixing said first end of said panel to said first attachment member;

affixing said second end of said panel to said second attachment member;

placing said panel under a predetermined amount of tension, wherein said tension is applied along a line passing through said first and second attachment members;

forming at least a first hole through said first end of said panel and said first attachment member while said panel is under said predetermined amount of tension; and forming at least a second hole through said second end of said panel and said second attachment member while said panel is under said predetermined amount of tension, wherein said second hole is a predetermined distance from said first hole.

30. The method of claim 29, further comprising:

forming at least a third hole through said first end of said panel and said first attachment member; and forming at least a fourth hole through said second end of said panel and said second attachment member.

31. The method of claim 29, wherein said predetermined amount of tension is about equal to an amount of tension said panel member will be under when said antenna reflector is deployed.

32. The method of claim 29, wherein said panel has a width corresponding to said first and second ends, and wherein said panel has a length corresponding to a first free edge and a second free edge.

33. The method of claim 29, further comprising:

interconnecting said first end of a plurality of said panel members to a first rib; and interconnecting said second end of a plurality of said panel members to a second rib.

34. A method for producing a panel member for use in a deployable antenna reflector, comprising:

providing a foldable fabric having a surface that is capable of reflecting electromagnetic radiation;

forming a panel having a first end and a second end from said fabric;

providing first and second attachment members;

affixing said first end of said panel to said first attachment member;

affixing said second end of said panel to said second attachment member;

placing said panel under a predetermined amount of tension, wherein said tension is applied along a line passing through said first and second attachment members;

forming at least a first hole through said first end of said panel and said first attachment member; and forming at least a second hole through said second end of said panel and said second attachment member, wherein said second hole is a predetermined distance from said first hole, and wherein said steps of affixing comprise affixing said first end of said panel to said first attachment member and said second end of said panel to said second attachment member with an adhesive.

35. A method for producing a panel member for use in a deployable antenna reflector, comprising:

providing a foldable fabric having a surface that is capable of reflecting electromagnetic radiation;

forming a panel having a first end and a second end from said fabric;

providing first and second attachment members;

affixing said first end of said panel to said first attachment member;

affixing said second end of said panel to said second attachment member;

placing said panel under a predetermined amount of tension, wherein said tension is applied along a line passing through said first and second attachment members;

forming at least a first hole through said first end of said panel and said first attachment member;

forming at least a second hole through said second end of said panel and said second attachment member, wherein said second hole is a predetermined distance from said first hole; and wrapping a portion of said first end of said panel member about said first attachment member and wrapping a portion of said second end of said panel member about said second attachment member, wherein said steps of affixing comprise affixing said first end of said panel to said first attachment member and said second end of said panel to said second attachment member with an adhesive.

36. A method for producing a panel member for use in a deployable antenna reflector, comprising:

providing a foldable fabric having a surface that is capable of reflecting electromagnetic radiation;

forming a panel having a first end and a second end from said fabric;

providing first and second attachment members;

affixing said first end of said panel to said first attachment member;

affixing said second end of said panel to said second attachment member;

placing said panel under a predetermined amount of tension, wherein said tension is applied along a line passing through said first and second attachment members;

forming at least a first hole through said first end of said panel and said first attachment member; and forming at least a second hole through said second end of said panel and said second attachment member, wherein said second hole is a predetermined distance from said first hole, wherein said panel has a width corresponding to said first and second ends, and wherein said panel has a length corresponding to a first free edge and a second free edge, and wherein said step of forming further comprises cutting said panel from said fabric, wherein said width of said panel is equal to said width of said formed panel member plus an amount of fabric sufficient to form hems along said first and second free edges, and wherein said length of said panel is equal to said length of said formed panel member plus an amount of fabric sufficient to wrap about said first and second attachment members and to form hems along said first and second ends.

37. A method for producing a panel member joined to a rib, comprising:

providing a panel, an attachment member and a rib;

forming a panel alignment in said panel;

forming an attachment member alignment in said attachment member;

forming a rib alignment in said rib;

connecting said panel and said attachment member together using said panel alignment and said attachment member alignment to define a panel member; and joining said panel member to said rib using said rib alignment.

38. The method of claim 37, wherein:

said panel alignment includes a hole and said attachment member first alignment includes a hole.

39. The method of claim 37, wherein:

each of said panel alignment and said attachment member alignment are used in conducting said joining step.

40. The method of claim 37, wherein:

said forming said panel alignment and said forming said attachment member alignment are conducted at substantially the same time.

* * * * *